US005294008A

United States Patent [19]

Dunaway

[11] Patent Number: 5,294,008

[45] Date of Patent: Mar. 15, 1994

[54] DISHWASHER NET

[76] Inventor: Jason Dunaway, 10250 Bissonnet, Suite 175, Houston, Tex. 77036

[21] Appl. No.: 974,605

[22] Filed: Nov. 12, 1992

[51] Int. Cl.[5] ..... A47F 5/00

[52] U.S. Cl. ..... 211/41; 248/499

[58] Field of Search ..... 211/41, 89, 74, 70.7; 248/499; 134/135; 160/368.1

[56] References Cited

U.S. PATENT DOCUMENTS

| | | | |
|---|---|---|---|
| 2,512,424 | 6/1950 | Goldstaub | 248/499 |
| 3,982,799 | 9/1976 | Murray . | |
| 4,047,550 | 9/1977 | Scholz . | |
| 4,366,949 | 1/1983 | Staub, Sr. . | |
| 4,635,799 | 1/1987 | Penner . | |
| 4,748,993 | 6/1988 | Llewellyn . | |
| 4,832,206 | 5/1989 | Cunningham . | |
| 4,834,125 | 5/1989 | Insalaco . | |
| 4,869,375 | 9/1989 | Lamb . | |
| 4,974,806 | 12/1990 | Matern . | |
| 5,114,019 | 5/1992 | Sandbank | 248/499 |
| 5,121,843 | 6/1992 | Elder . | |
| 5,201,826 | 4/1993 | Zimmermann | 211/41 |

FOREIGN PATENT DOCUMENTS 1075589 4/1954 France .

*Primary Examiner*—Alvin C. Chin-Shue
*Assistant Examiner*—Sarah A. Lechok
*Attorney, Agent, or Firm*—Vaden, Eickenroht, Thompson, Boulware & Feather

[57] ABSTRACT

There is disclosed an article for restraining movement of objects in a dishwasher rack including a heat resistant, elastic net, which, when secured across the top opening of the rack, remains substantially flat over objects not exceeding the height of the rack and has openings to permit it to receive and to conform to the sides of other objects whose height does exceed that of the rack.

3 Claims, 1 Drawing Sheet

DISHWASHER NET

BACKGROUND OF THE INVENTION

1. Field of the Invention

This invention relates generally to an article for restraining movement of objects carried on the rack of a dishwasher and, more particularly, to improvements in articles of this type comprising a net for disposal over objects in the rack.

2. Description of the Prior Art

As well known in the art, most dishwashers include a door mounted to a housing having dish racks that move from a position outside the housing for loading and unloading the objects, namely dishes, glasses, etc. to a position inside the housing for storing and washing the objects. Jets are usually positioned on the top and bottom of the housing, that is above and below the racks, to direct the water under high pressure inward in order to cover the maximum amount of surface area on the objects.

Generally, a household dishwasher rack is a substantially rectangular basket having prongs extending upward from the bottom of the rack to provide support for and separate objects loaded into the rack. Objects, such as cups, glasses, plates and bowls, are placed in the rack between prongs. Except when they are large enough to be held in the rack by friction, the objects are not restrained in the rack other than the proximity of other objects, the prongs, and the sides of the rack.

Water from the high pressure jets causes movement of the unrestrained objects. When the objects are glass or ceramic, many times the movement will cause them to collide and chip or break. When the objects, such as bowls, cups or glasses are plastic, the force of the jets is generally sufficient to capsize the objects when there is sufficient vertical room. Once capsized, the objects are filled with the dirty water and as the racks are removed for unloading, this water usually spills onto the floor.

Many attempts have been made to overcome these damage and capsizing problems. For example, U.S. Pat. No. 3,982,799 discloses limp meshes or nets installed in areas above the racks and adapted to be lowered onto the objects in the respective rack as the door is closed. One problem associated with this apparatus is that the meshes may obstruct any cleansing action. Also, when two taller objects surrounding shorter objects suspend the mesh over the shorter objects, the shorter objects are no longer restrained from movement and are thus susceptible to damage and capsizing. In addition, the mesh material would presumably have a very short life span due to the constant moisture and high temperatures.

U.S. Pat. No. 4,832,206 discloses an elastic or resilient mesh designed to cover one row or column of the rack. In addition to the hassle of positioning one mesh for each row or column of each rack, this mesh would not prevent the damage and capsizing problems described above.

In the apparatus of U.S. Pat. No. 4,974,806, elongate, flexible, parallel cords contact both sides of objects in a row or column such that there is sufficient pressure to hold the objects in place. One problem associated with this apparatus is the hassle of positioning one parallel cord unit for each row or column of each rack. In addition, the restraining pressure will be uniformly applied to each object only if the objects are all of the same lateral dimension. Thus, two narrow objects surrounded by two wide objects would not be restrained at all.

Although the net of U.S. Pat. No. 5,121,843 is more easily installed, it is nevertheless susceptible to the problems of damage and capsizing described above.

Therefore, it is an object of the present invention to provide a low cost net which prevents such damage to and capsizing of the objects placed in the dishwasher rack.

It is another object of the present invention to provide such a net which is temperature and moisture resistant.

SUMMARY OF THE INVENTION

These and other objects are accomplished in accordance with the invention, by a net of elastic material having an outer periphery conforming substantially to that of the open top of the rack is attached to the rack, and being sufficiently stiff that it will remain substantially flat above objects whose height does not exceed that of the rack to prevent vertical movement of these objects. More particularly, the openings being adjacent strands of the net ar of such size that the taller objects whose lateral dimensions exceed somewhat the lateral dimensions of the openings may extend therethrough without lifting the net from above the shorter objects. Preferably, the net is made of a highly temperature and moisture resistant material, such as a silicon rubber compound, which not only restrains object movement in the rack thus preventing damage and capsizing, but also withstands the high temperature during the washing cycle to extend the life time of the net.

BRIEF DESCRIPTION OF THE DRAWINGS

In the drawings, wherein like reference characters are used throughout to designate like parts.

DESCRIPTION OF THE PREFERRED EMBODIMENT

Figure 1:
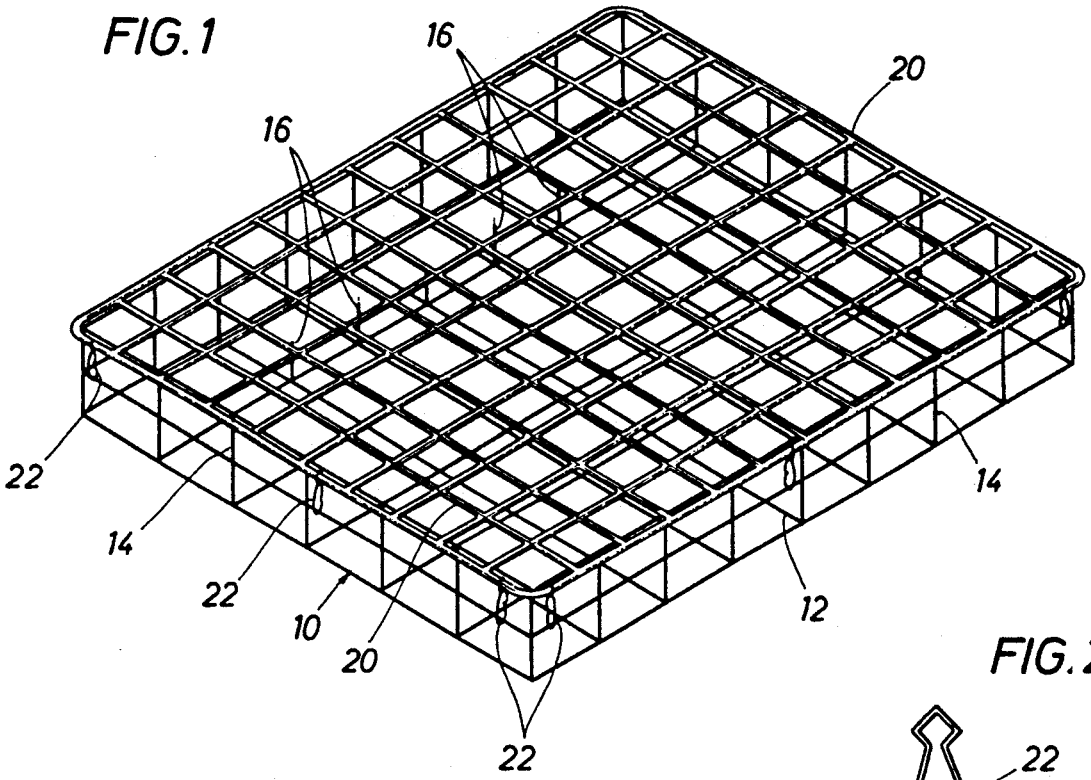
FIG. 1 is a perspective view of a dishwasher rack covered by a restraining net made in accordance with the preferred embodiment of this invention.

Turning to the drawings and first to FIG. 1, a typical dishwasher rack, generally referred as rack 10, is shown. Rack 10 is substantially rectangular having a bottom 12 and four sides 14 usually made of parallel strips of plastic coated sturdy wire. Separators 16 in the form of prongs, also made of plastic coated sturdy wire, are spaced on and directed upward from bottom 12 as shown.

Figure 2:
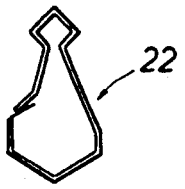
FIG. 2 is a side view of a hook used to attach the net of FIG. 1 to a dishwasher rack.
Figure 3:
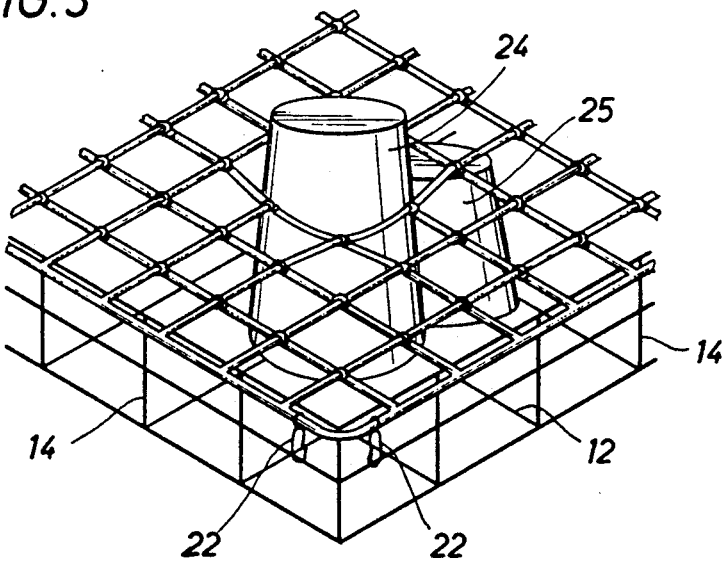
FIG. 3 is a perspective view of the net of FIG. stretched around objects in a dishwasher rack.

In the preferred embodiment of this invention, the periphery of an elastic, heat resistant net 20 substantially conforms to the rectangular shape of rack 10 so that it may be positioned across its open top, as shown. However, as shown in FIGS. 1 and 3, the edges of the net overlap slightly the periphery of rack 10 to facilitate the securing of the net by using several of the simple, inexpensive clips 22, shown in FIG. 2. Clips 22 are attached at spaced apart increments around the periphery of net 20 which is then stretched across the top of rack 10 and connected to sides 14. Once connected, net 20 is sufficiently stiff to remain substantially flat across the top of rack 10.

In the preferred embodiment of this invention, net 20 is comprised of intersecting strands of a silicon rubber compound tied together at the intersections of the strands in a manner well known to those skilled in the art. As shown, the strands intersect at 90° angles form openings large enough and resilient enough to stretch around an object such as cup 24 whose height exceeds that of rack 10 and yet remains substantially flat over shorter objects such as cup 25, shown in FIG. 3, whose height is less than that of the rack. Net 20 provides a barrier to any upward movement by objects whose height does not exceed that of rack 10, thus preventing the capsizing of the smaller objects. Although net 20 of the preferred embodiment is made of strands of a silicon rubber compound, the net could be made from any other material and in any manner to produce a net having the characteristics described above.

Figure 4:
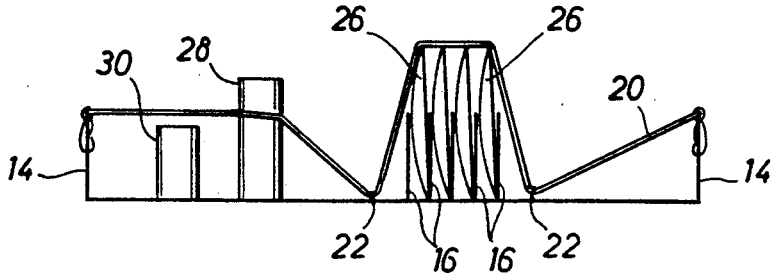
FIG. 4 is a side view of the rack and net covering different shaped objects.

In the event that the objects placed in rack 10 are too large to fit inside an opening in net 20, net 20 can be stretched over the top of the object and fastened to bottom 12 of rack 10. FIG. 4 shows net 20 stretched over plates 26 and fastened with hooks 22 to bottom 12 on either side of the plates. The net being resilient holds plates 26 stationary to prevent damage. The other objects 28 and 30 which are placed between hooks 22 and side 14 are also prevented from damage and capsizing, as described above.

Even though the preferred embodiment of this invention is designed for a household dishwashers, this invention could easily be adapted for commercial dishwashers. Thus, the invention is not limited to the size and shape described above.

It will be understood that certain features and subcombinations are of utility and may be employed without reference to other features and subcombinations. This is contemplated by and is in the scope of the claims.

As many embodiments as possible may be made of the invention without departing from the scope thereof, it is to be understood that all matter herein set forth or shown in the accompanying drawings is to be interpreted as illustrative and not in a limiting sense.

What is claimed is:

1. An article for use in restraining movement of objects carried on the rack of a dishwasher, comprising a net of elastic material having an outer periphery conforming substantially to that of the open top of the rack, said net being sufficiently stiff that it will remain substantially flat above objects whose height does not exceed that of the rack, but sufficiently flexible to permit it to conform to the sides of other objects whose height does exceed that of the rack when fastened to the rack on opposite sides of the other objects, and the openings between adjacent strands of the net being of such resiliency that the adjacent strands stretch around taller objects whose lateral dimensions exceed somewhat the lateral dimensions of the openings without lifting the net from above objects whose height does not exceed that of the rack.

2. An article in accordance with claim 1, wherein said net is made of a heat resistant, moisture resistant silicon rubber compound.

3. An article in accordance with claim 2, wherein the intersecting strands of the net are connected to one another by knots at each intersection.

* * * * *